US006732781B2

(12) United States Patent
Bouveresse

(10) Patent No.: US 6,732,781 B2
(45) Date of Patent: May 11, 2004

(54) HAND-HELD DEVICE FOR TRANSFERRING A FILM ONTO A SUBSTRATE WITH A CONCEALABLE APPLICATION MEMBER

(75) Inventor: Jeanne-Antide Bouveresse, Reuil Malmaison (FR)

(73) Assignee: Societe BIC (FR)

( * ) Notice: Subject to any disclaimer, the term of this patent is extended or adjusted under 35 U.S.C. 154(b) by 0 days.

(21) Appl. No.: 10/226,251

(22) Filed: Aug. 23, 2002

(65) Prior Publication Data

US 2003/0051820 A1 Mar. 20, 2003

Related U.S. Application Data

(63) Continuation of application No. PCT/EP01/01533, filed on Feb. 12, 2001.

(30) Foreign Application Priority Data

Feb. 25, 2000 (EP) ..... 00103991

(51) Int. Cl.[7] ..... B32B 31/00

(52) U.S. Cl. ..... 156/577; 156/523; 156/579; 118/76; 118/257; 242/160.4; 242/171; 242/588.6; 206/411

(58) Field of Search ..... 156/523, 577, 156/579, 574, 527, 238, 540; 118/200, 257, 76; 225/46; 206/411; 242/170, 171, 588.3, 588.2, 588.6, 588, 160.2, 160.4

(56) References Cited

U.S. PATENT DOCUMENTS

| | | | | |
|---|---|---|---|---|
| 4,849,064 | A | 7/1989 | Manusch et al. | 156/577 |
| 4,891,090 | A | 1/1990 | Lorincz et al. | 156/577 |
| 5,346,580 | A | 9/1994 | Elges et al. | 156/540 |
| 5,679,156 | A | 10/1997 | Matsumaru | 118/200 |

FOREIGN PATENT DOCUMENTS

| | | | | |
|---|---|---|---|---|
| DE | 29511439 | U | 9/1995 | N65H/35/07 |
| JP | 1029179 | A | 1/1989 | H04N/5/74 |
| JP | 10324092 | A | 12/1998 | B43L/19/00 |
| WO | WO 99/23022 | A | 5/1999 | B65H/37/00 |

*Primary Examiner*—Richard Crispino
*Assistant Examiner*—Cheryl N. Hawkins

(57) ABSTRACT

A hand-held device for transferring a film of, for example, an adhesive, a covering, or colored material, from a supply tape onto a substrate. The device has a base body, in which the supply and an application member are provided, and a cover for the application member. The cover is movable between a covering position, covering the application member, and a release position, exposing the application member. The cover is pivotably attached to the base body and to maintain the overall compactness of the device, the cover substantially follows the circular outline defined by the outer contour of the base body with minimal clearance gap between the cover and the base body.

17 Claims, 4 Drawing Sheets

HAND-HELD DEVICE FOR TRANSFERRING A FILM ONTO A SUBSTRATE WITH A CONCEALABLE APPLICATION MEMBER

CROSS-REFERENCE TO RELATED APPLICATIONS

This application is a continuation of PCT Application No. PCT/EP01/01533, filed on Feb. 12, 2001, which claims priority to European Patent Application 00 103 991.6, filed on Feb. 25, 2000. The entire contents of these two applications is expressly incorporated herein by reference.

FIELD OF THE INVENTION

The invention relates to a hand-held device for transferring a film of, for example, an adhesive, a covering, or colored material from a backing tape onto a substrate.

BACKGROUND OF THE INVENTION

A hand-held device for transferring a film onto a substrate by pressing a supply of film fixed on a strip of backing tape, using a spatula-like application member is known in the art. The application member typically protrudes out from the body of the hand-held device with the backing tape running over it so that the backing tape will be sandwiched between the application member and the substrate. The hand-held device is manually gripped and the application member is moved across the substrate so that the film is automatically released from the backing tape of the supply and pressed onto the substrate by the application member. Because the application member protrudes from the hand-held device with the film, there is also a risk that the sensitive film could be damaged when the hand-held device is not in use. Damaged film can lead to undesirable defects in the transferred layer of film, leading to undesirable defects during application of the film onto the substrate, especially at the start of the application of the film. In addition, where the film is a colored material or an adhesive, there is a danger that unintended objects could come into contact with the application member while the hand-held device is not being used and the object can be unintentionally coated with the film.

To avoid the drawbacks described above, DE 195 33 567 A discloses a hand-held device of the above-described type which is provided with a protective lid which is pivotably connected to a housing of the hand-held device by a joint and is pivotably mounted between a non-use position, where the application member is covered, and a use position, where the application member is exposed.

EP 0 313 720 B1 (corresponding to U.S. Pat. No. 4,849, 064 to Manusch et al.) describes a hand-held device for transferring a film from a backing foil onto a substrate in which a supply reel and a take-up reel for the backing tape are arranged on a replaceable cassette unit which also bears the application member. The associated housing takes on the form of a housing lid. The cassette unit is swivellable, by means of a swivel arm hinged onto the housing. In its use position, the cassette unit resides in the housing lid and the application member projects from the housing lid so that it can be pressed onto the substrate to transfer the film onto the substrate. To replace the cassette unit, it is swivelled out of the housing lid and exchanged with a new cassette.

EP 0 575 790 B, (corresponding to U.S. Pat. No. 5,346, 580 to Elges et al.) also, describes a hand-held device having a cassette unit which bears a supply reel, a take-up reel, and an application member. The housing for the hand-held device has an oblong construction and the cassette unit is longitudinally displaceable in the housing between a use position, in which the application member projects outside through an opening in the housing and, thus, can be pressed against the substrate, and a non-use position in which the application member is retracted in the housing. The cassette unit has a rear end that protrudes from the housing. The cassette unit can be pushed into the use position by exerting manual pressure on the rear end of the cassette unit to push the cassette unit against a restoring spring which biases the cassette unit into its non-use position. The cassette unit can be locked in its use position by a spring loaded detent device provided between the cassette and the housing. The detent device has a press-button for releasing the detent to restore the cassette into its non-use position.

But the above known configurations make inefficient use of space because the cover typically needs a relatively large clearance of motion, i.e., the cover's movement between its use and non-use position requires a relatively large surrounding space. This is also the case in the hand-held device described in EP 0 575 790 B1 because the rear end of the base body protrudes from the housing. If one were to dispose the base body of this hand-held device completely in the housing, the base body would need a relatively large interior free space in the housing.

SUMMARY OF THE INVENTION

The present invention provides an improved hand-held device for transferring a film on to a substrate that is spatially more efficient. The hand-held device of the present invention provides a pivotably attached cover for its application member. The cover requires as little clearance of motion as possible and results in a compact design.

In the hand-held device of the present invention, the cover essentially follows the outer contour of the base body during its pivoting movement. The movement of the cover is therefore not directed transversely to the outer contour of the base body, as is the case in the prior art devices, but is directed along the outer contour of the housing. As a result, the clearance gap between the cover and the outer contour of the base body remains substantially constant throughout movement of the cover, thus advantageously exploiting the space available. The cover can be formed to overlap the rim of the base body in a U-shaped fashion both in its covering or non-use position and in its release or use position.

A particularly advantageous embodiment can be achieved when the cover is provided with a range of movement along a circular arc section, the outer contour of the base body preferably also being formed in a corresponding circular arc shape.

In one embodiment of the invention, the cover at least partially covers the base body in its covering or non-use position. In doing so, the cover fulfils its covering function not only for the application member but also for the base body. It is therefore possible within the scope of the invention for the cover to conceal the majority of the base body or to conceal the entire base body when in its non-use position.

In all the embodiments of the invention, it is advantageous that the outer contour of the base body be formed in the shape of a circular section, in at least the section to be covered by the cover, and to mount the cover such that it can be swivelled. In doing so, it is advantageous that the center of curvature of the outer contour of the base body and the swivel axis of the cover lie on essentially the same axis. This minimizes the clearance gap between the inner surface of the cover and the outer contour of the base body so that a compact construction can be achieved.

The cover may be made to be as thin as possible. It is particularly advantageous to form the cover in the form of a section of a circle with the flattened part being beyond the center of curvature in the sense of a secant. This design also improves handling when the size of the cover shaped as a section of a circle is adapted to the size of the user's hand such that the operating hand can extend over the cover, and the base body can be gripped and held between the thumb and at least one finger of the user's hand. To improve the grip, it is advantageous to form the grippable side surfaces of the base body such that they are easy to grip, e.g., to make them rough or with furrows or gripping grooves.

The base body can thereby have the shape of an essentially circular disc with the application member projecting radially from the base body. In this case, the clearance of motion between the base body and the cover is to be of such a size that the application member can be swung under the cover or the cover can be swung over the application member by effecting a relative movement between the base body and the cover.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
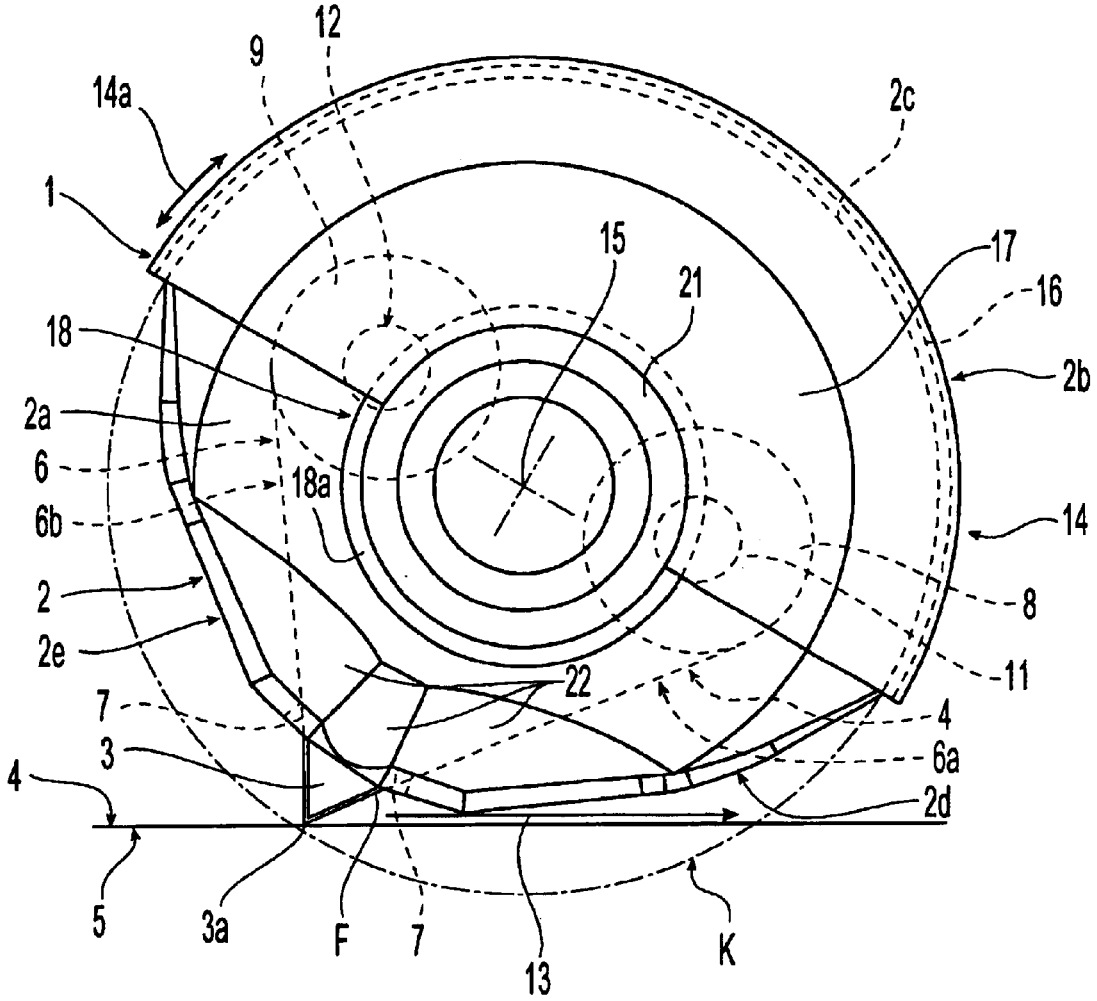
FIG. 1 illustrates a side elevational view of a hand-held device as per the invention in its use or release position.

FIG. 1 illustrates a side view of an embodiment of the present invention in its use position. The hand-held device 1 has a base body 2 from which an application member 3 projects. A film 4 of, for example, an adhesive, a covering, or a colored material is provided on a backing tape 6, a supply of which is disposed in base body 2 on a supply reel 8. Film 4 is transferred onto substrate 5 by pressing application member 3 onto substrate 5 while sliding application member 3 along substrate 5. In doing so, the film is pulled off supply reel 8 located in base body 2.

In the present embodiment, film 4 is provided on a backing tape 6 in the form of a foil strip running with an approach section 6*a* from supply reel 8 to application member 3 and deflecting around application member 3. In the use or release position illustrated in FIG. 1, approach section 6*a* is located below application member 3 and return section 6*b* is located above application member 3. Application member 3 is a spatula-shaped component. The essentially straight tip 3*a* of application member 3 is oriented at a right angle to the deflection plane of backing tape 6. Two through holes 7 are provided in base body 2, one below the approach side of application member 3 and one above the return side of application member 3. Backing tape 6 extends through these holes from and into hollow base body 2 in which supply reel 8 and a take-up reel 9 are mounted. Each of supply reel 8 and take-up reel 9 is mounted so as to be freely rotatable on a bearing axis 11 and 12, respectively.

In the present embodiment, base body 2 is substantially disc-shaped with two opposing side walls 2*a* and a peripheral wall 2*b* connecting side walls 2*a* to each other. Side walls 2*a* and peripheral wall 2*b* form hollow base body 2 in which supply reel 8 and take-up reel 9 are freely rotatably mounted on bearing axes 11 and 12, respectively.

Looking at the deflection plane from the side, the side of the base body 2 facing away from the application member 3 in the use position depicted in FIG. 1 has the shape of a semi-circle, the tip 3*a* being disposed in the region of an imaginary extension of base body 2.

Figure 2:
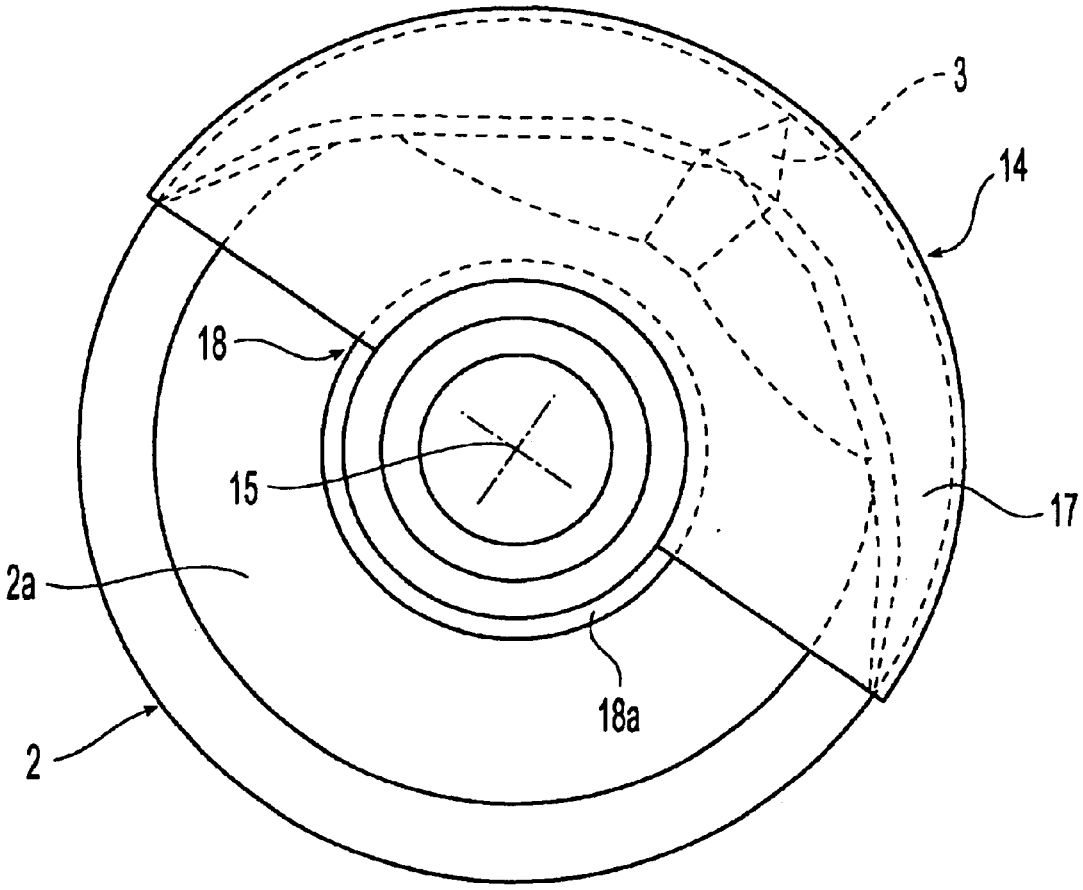
FIG. 2 illustrates the hand-held device of FIG. 1 in its non-use or covered position.

As illustrated in FIGS. 1 and 2, peripheral wall 2*b* of base body 2 opposite application member 3, i.e., rear side 2*c*, has a semi-circular curvature. The position of application member 3 is such that tip 3*a* lies close to or on the circle defined by the substantially disc-shaped base body 2, represented by curve K. Curve K represents the full circle formed when the contour of the curve of the semi-circular rear side 2*c* of base body 2 is extended. On the front side of base body 2, peripheral wall sections 2*d*, 2*e*, respectively located below and above application member 3, run approximately flattened or secantial and possibly slightly convex in shape. Peripheral wall sections 2*d*, 2*e* begin at a distance behind tip 3*a* and diverge rearwards and away from the center of curve K, running out into the region of an axial transverse plane extending between the front side and the rear side on the circumference of the base body 2. Base body 2 therefore has the shape of a substantially round disc, with a free space F being available at least between the lower flattened circumferential section 2*d* and curve K. Free space F provides the necessary clearance space between substrate 5 and base body 2 when hand-held device 1 is in use.

Between supply reel 8 and take-up reel 9 there is disposed a transmission gearing with an integrated sliding clutch (not illustrated). When hand-held device 1 is moved across the surface of substrate 5 in the direction of arrow 13 transferring film 4 onto substrate 5, supply reel 8 is driven by the forward moving approach section 6*a* of backing tape 6. At the same time, the transmission gearing causes take-up reel 9 to be driven at a circumferential speed that results in the take-up speed of take-up reel 9 to be greater than the unwinding speed of supply reel 8, even with the smallest winding size of supply reel 8 (empty supply reel 8) and the largest winding size of take-up reel 9 (full take-up reel 9). This exerts a slight tension on return section 6*b* of backing tape 6 and the provided sliding clutch compensates so that backing tape 6 is always taut and does not rip under tension.

Base body 2 can be divided such that when supply reel 8 is empty, the reels can be replaced. It is also possible within the scope of the invention to arrange reels 8 and 9, preferably including application member 3, on a replaceable cassette (not illustrated) which can, for example, be inserted into base body 2 from behind and can be positioned by suitable positioning means.

Hand-held device 1 comprises a cover 14 which is pivotably connected by a joint to base body 2 for pivoting between a use or release position and a non-use or covering position. In the non-use position, cover 14 covers application member 3 and part of base body 2 adjacent to application member 3. In the use position, on the other hand, cover 14 is pivoted towards rear end 2*c* of base body 2 exposing these parts so that application member 3 can be pressed against substrate 5 to transfer film 4 thereto.

Cover 14 comprises a cover wall 16 covering a portion of peripheral wall 2*b* of base body 2 with a clearance of motion. Cover 14 is movable in a guide 18 running in the peripheral direction of base body 2. Guide 18 maybe formed by the joint connecting cover 14 to base body 2. It is preferable for cover side walls 17 to extend radially inwards from the side edges of cover wall 16 to partially cover base body 2 on both sides and thus give cover 14 the shape of a cap. As can be appreciated, side edges of cover wall 16 partially cover base body 2 from three sides in a U-shaped manner so that portions of peripheral wall 2*b* as well as side walls 2*a* of base body 2 are covered. This produces an optimum covering which surrounds application member 3 on three sides in the covered, release position.

Figure 3:
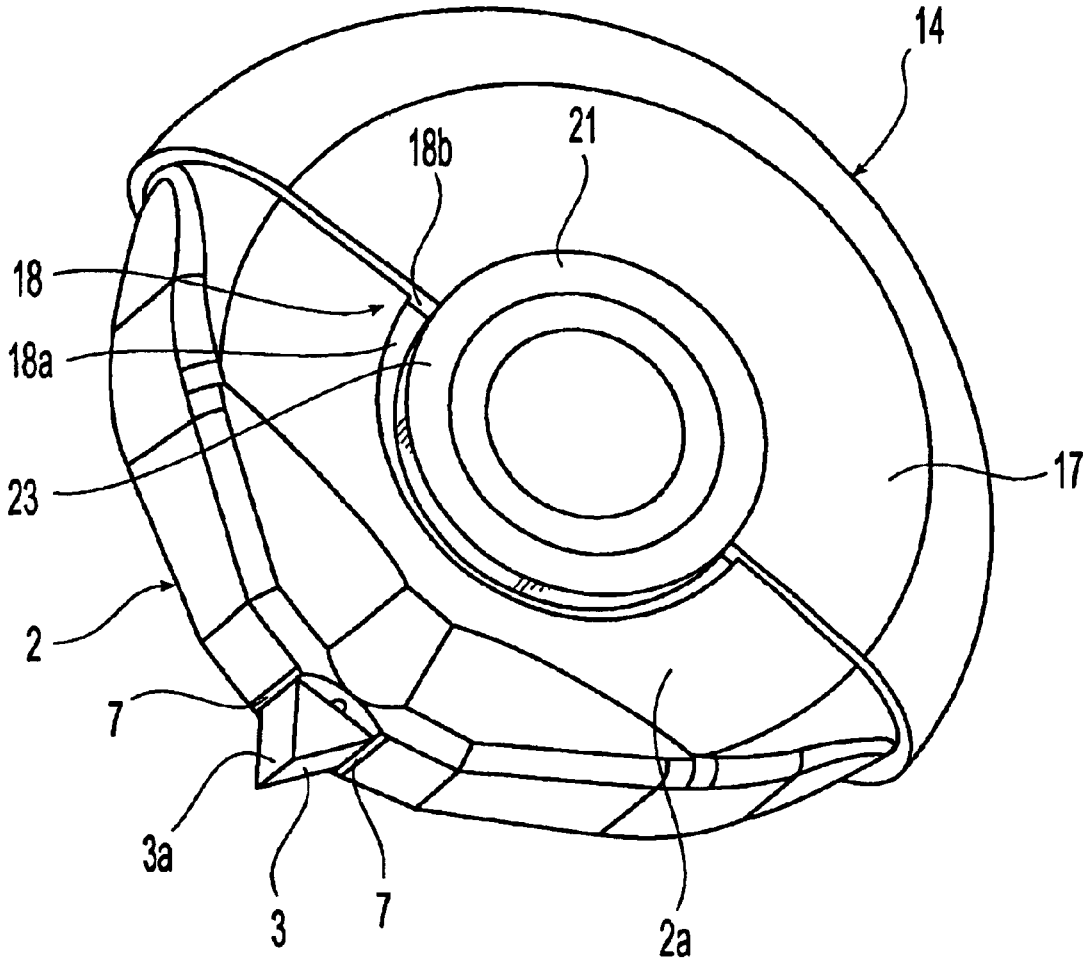
FIG. 3 is a perspective view of the hand-held device in a use position.

As illustrated in FIG. 3, guide 18 is preferably curved in the shape of an arc of a circle and can be formed by a circular arc like guide groove 18*a* in one of the component parts, and a mating circular arc-like guide web 18*b* on the other component part that engages guide groove 18*a* with clearance of motion. For example, in the present embodiment, the guide groove 18*a* of cover 14 is arranged outside on at least one side in respective side walls 2*a* of base body 2 while guide web 18*b* projects inwards from the corresponding cover side wall 17 towards guide groove 18*a*. In this embodiment, cover wall 16 and/or its direction of movement 14*a* follows the outer or peripheral contour of base body 2.

Articulated axis 15 of the joint runs through the center of curvature of guide 18 curved in a circular arc (i.e., the center of the circle defined by circular guide 18) and is preferably located in the axis of circular line K. Guide 18 can be formed by an annular groove so that an endless relative rotational movement between base body 2 and cover 14 can be performed. In the present embodiment, cover 14 stretches over approximately 180° of the curve of base body 2 in the peripheral direction. Cover 14 can cover approximately half of the disc-shaped base body 2, wherein cover 14 covers the rear half of base body 2 and exposes application member 3 when in the use position, as illustrated in FIG. 1, and covers the front half of base body 2 including application member 3 when in the non-use position, as illustrated in FIG. 2. In the side view transverse to the deflection plane, cover 14 therefore roughly has the shape of a semi-circle. Preferably a semi-circular free space 21 is also provided inside the guide member affiliated with cover 14, i.e., guide web 18*b*. In the region defined by free space 21, side walls 2*a* of base body 2 are not covered and are therefore open.

In the region of the rear half of base body 2, the cross-section of peripheral wall 2*b* of base body 2 is rounded, particularly semi-circular, along the articulating axis 15. Cover wall 16 is adapted to the cross-sectional shape of peripheral wall 2*b* of base body 2 with a small amount of clearance so that there is just a small gap between these parts. In the region of the peripheral sections 2*d*, 2*e*, the peripheral surface can also be rounded or flat in its cross-section. The edges in the region of the flat or slightly bulging peripheral sections 2*d*, 2*e* may be curved or chamfered.

In the use position, as illustrated in FIG. 1, base body 2 can be gripped in a user-friendly manner between a thumb and at least one finger of the user's hand with the user's hand reaching over the cover 14. In doing so, the palm of the user's hand can be rested on cover wall 16 of cover 14. To improve gripping, the surface of side walls 2*a* of base body 2 may be appropriately textured. For example, side walls 2*a* can be rough or provided with small grooves or one or more gripping recesses 22, i.e., concave surfaces, in which the fingers can engage and hold base body 2 more firmly. Free space 21 increases the gripping surface available for the fingers, thus further improving gripping. In the present embodiment, a cylindrical material shoulder 23 is disposed on side walls 2*a*, coaxially with articulating axis 15, and which fills the respective free space 21. Shoulder 23 can have axial measurements which enable it to seal cover side walls 17 with the outer side surface. In the non-use or covering position, application member 3 is protected on all open sides by cover 14. The movement between base body 2 and cover 14 is relative. This means that one of these parts can be moved relative to the other one which is kept in place.

Base body 2, cover 14, and application member 3 are preferably made of plastic such that they can be produced as accurately shaped molded plastic parts and at reasonable costs.

Figure 4:
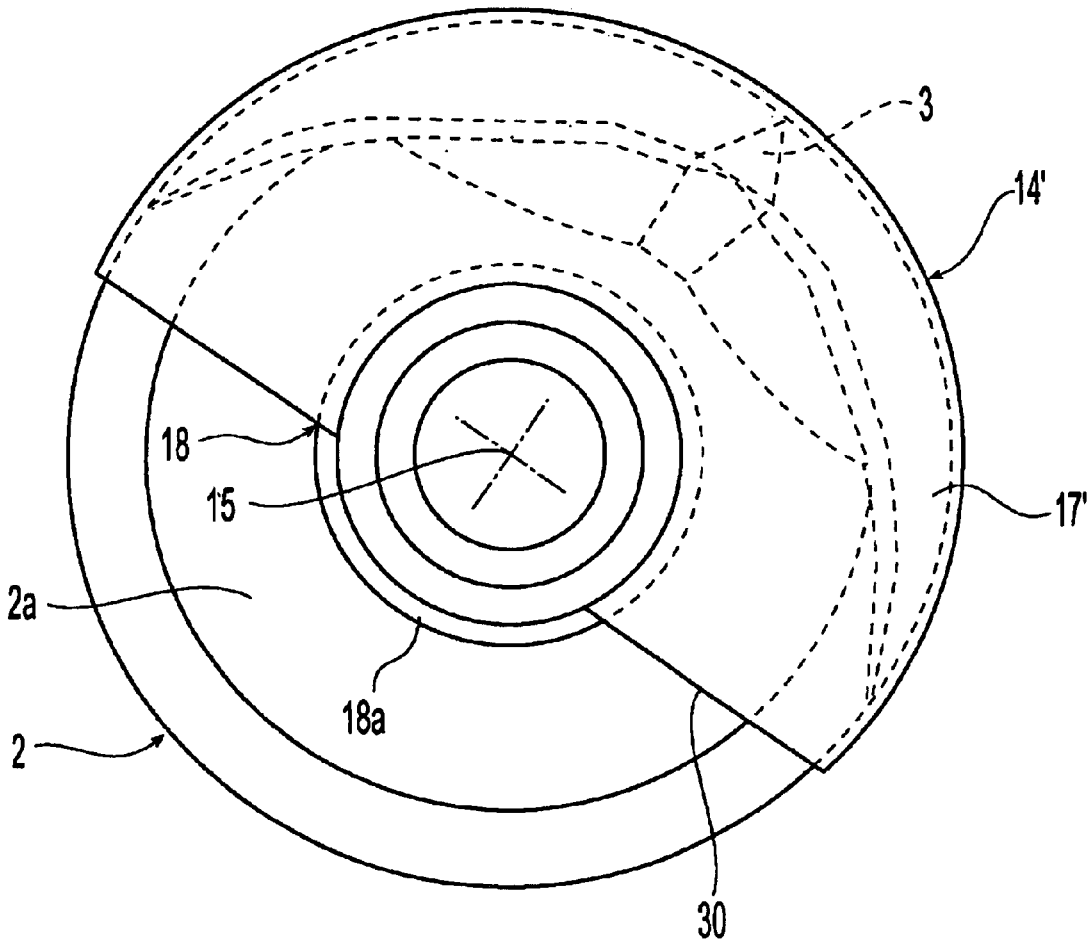
FIG. 4 illustrates another embodiment of the hand-held device of FIG. 2.

FIG. 4 illustrates another embodiment of the hand-held device of the present invention where side walls 17' of cover 14' are larger than the semi-circle embodiment illustrated in FIG. 2. Unlike cover 14 of the hand-held device of FIG. 2, cover 14' of the hand-held device of FIG. 4 is in the form of a section of a circle with the flattened part 30 being beyond the center of curvature in the sense of a secant.

What is claimed is:

1. A device for transferring a film from a backing tape onto a substrate, said device comprising:

a base body having two opposing side walls and a peripheral wall between said side walls;

an application member extending from said base body; and a cover overlapping said side walls and said peripheral walls of said base body in a U-shaped manner both in covering position covering said application member and in a release position exposing said application member.

2. A device according to claim 1 wherein said cover further comprises:

a cover wall extending peripherally over said peripheral wall of said base body; and two cover side walls extending from said cover wall to overlap said side walls of said base body.

3. A device for transferring a film from a backing tape onto a substrate, said device comprising:

a base body having two opposing side walls and a peripheral wall between said side walls;

an application member extending from said base body;

a cover pivotably coupled to said base body by a joint and overlapping said base body in a U-shaped manner both in a covering position covering said application member and in a release position exposing said application member; and a guide formed by said joint;

wherein said cover is movable in said guide between said covering position and said release position.

4. A device according to claim 3, wherein said guide is disposed between said cover and said base body.

5. A device according to claim 3, wherein said cover is formed by a cover wall extending peripherally about said base body and two cover side walls extending from said cover wall, said cover wall and said cover side walls forming a U-shaped cross-section of said cover and said cover side walls partially covering said side walls of said base body.

6. A device according to claim 3, wherein said guide is formed between at least one side wall of said cover and at least one side wall of said base body.

7. A device according to claim 3, wherein said guide has a circular shape with a center.

8. A device according to claim 3, wherein:

said guide is formed by a guide groove in one of said base body and said cover and a guide web in the other of said base body and said cover; and said guide web engaging said guide groove with a clearance of motion.

9. A device according to claim 8, wherein:

said guide groove is provided in at least one of said two side walls of said base body;

and said guide web is provided on at least one of said two side walls of said cover adjacent to said at least one of said two side walls of said base body.

10. A device according to claim 7, wherein:

said base body has the shape of a substantially round disc with a central axis; and said center of said circular shaped guide lies approximately on said central axis of said base body.

11. A device according to claim 10, wherein said round disc shape of said base body is flattened on said peripheral wall sections arranged above and below said application member.

12. A device according to claim 3, wherein said cover has side walls which have the shape of a semicircular segment.

13. A device according to claim 8, wherein said guide groove is an annular guide groove; and said guide web is an annular guide web.

14. A device for transferring a film from a backing tape onto a substrate, said device comprising:

a base body having two opposing side walls and a peripheral wall between said side walls;

an application member extending from said base body;

a cover formed by a cover wall extending peripherally about said base body and two cover side walls extending from said cover wall; and a guide formed between at least one of said cover side walls and at least one of said two side walls of said base body;

wherein said cover is pivotably movable in said guide between a covering position covering said application member and a release position exposing said application member.

15. A device according to claim 14, wherein said guide has a circular shape with a center.

16. A device according to claim 14, wherein:

said guide is formed by a guide groove in one of said base body and said cover and a guide web in the other of said base body and said cover; and said guide web engages said guide groove with a clearance of motion.

17. A device according to claim 16, wherein said guide groove is an annular guide groove; and said guide web is an annular guide web.

* * * * *